United States Patent [19]

Falendysz et al.

[11] 4,366,747

[45] Jan. 4, 1983

[54] SLIPPER ARRANGEMENT FOR HYDRAULIC PUMP

[75] Inventors: E. L. Falendysz; Eldon M. Brumbaugh, both of Racine, Wis.

[73] Assignee: J. I. Case Company, Racine, Wis.

[21] Appl. No.: 176,826

[22] Filed: Aug. 11, 1980

[51] Int. Cl.[3] ..... F01B 1/02; F04B 39/10

[52] U.S. Cl. ..... 92/72; 91/490; 417/273; 417/539

[58] Field of Search ..... 91/490, 488; 417/269, 417/539, 273; 92/72

[56] References Cited

U.S. PATENT DOCUMENTS

| | | | |
|---|---|---|---|
| 2,394,285 | 2/1946 | Bevins | 417/273 |
| 3,036,557 | 5/1962 | Kimsey | 91/490 |
| 3,168,006 | 2/1965 | Bennett | 91/490 |
| 3,320,902 | 5/1967 | Paschke | 417/273 |
| 3,744,380 | 7/1973 | Sterger | 417/273 |

FOREIGN PATENT DOCUMENTS

| | | | |
|---|---|---|---|
| 2616192 | 10/1976 | Fed. Rep. of Germany | 417/273 |
| 2829994 | 11/1979 | Fed. Rep. of Germany | 417/539 |
| 2909248 | 9/1980 | Fed. Rep. of Germany | 91/488 |
| 2328863 | 5/1971 | France | 417/464 |
| 2379711 | 1/1978 | France | 417/536 |
| 1246647 | 9/1968 | United Kingdom | 417/464 |

*Primary Examiner*—William L. Freeh

*Attorney, Agent, or Firm*—Cullen, Sloman, Cantor, Grauer, Scott & Rutherford

[57] ABSTRACT

An improved slipper is disclosed for a fluid pressure pump of the radial piston type for operably connecting a piston to a cam lobe on a crankshaft. The slipper includes an inner arcuate side surface for engagement with the cam lobe on the crankshaft and an opening through the slipper body to permit centrifugal flow of fluid for piston filling. The opposite side of the slipper body includes a recess for retaining a hardened annular seat inert. The spherical head of the piston rides on the inner circumference or edge of the insert, and the sharp edge of the insert provides a wiping action on the piston head as relative motion occurs between the piston and slipper. Further, an open area is provided on both sides of the line of contact between the piston and slipper to prevent contaminants from entering between the contacting surfaces which would spoil the seat.

2 Claims, 2 Drawing Figures

SLIPPER ARRANGEMENT FOR HYDRAULIC PUMP

BACKGROUND OF THE INVENTION

The present invention relates to piston and slipper arrangements used in hydraulic pumps, and more particularly, to an improved slipper which prevents harmful contaminants from being embedded in the surface of the seat between the piston and slipper.

It is conventional to provide a hydraulic pump including a plurality of radially reciprocating pistons having enlarged spherical ends and slippers that are articulately mounted on the spherical ends of the pistons. The slippers engage a cam surface on a cam or reaction member of a rotatable drive shaft. One typical slipper design includes a dished thrust surface in the shape of a truncated cone which is in engagement with the spherical head of a respective piston. The rotative force of the drive shaft is transmitted through the slippers to cause the pistons to reciprocate.

A problem with known piston-slipper arrangements is that there are crevices formed adjacent the contact area between the spherical end of the piston and the dished thrust surface of the slipper which permit contaminants to lodge or jam. As relative motion occurs between the piston end and slipper, the contaminants can enter between the contact surfaces, thereby spoiling the seat.

Thus, there has been a need for an improved slipper which prevents harmful contaminants from being embedded in the surface of the seat between the piston and slipper. The disadvantages of present piston and slipper arrangements have resulted in the slipper of the present invention which effectively eliminates the potential for contaminants to enter the contact surface between the piston and slipper with resultant spoiling of the seat.

SUMMARY OF THE INVENTION

The slipper of the present invention is used in hydraulic pumps of the radial piston type of either fixed or variable displacement for operably connecting an individual piston to a cam surface on the drive shaft. In the disclosed embodiment, the pump includes one or more lines of radially extending pistons arranged around the drive shaft. Each piston has an axial drilling which permits fluid flow in through the piston head. The piston head is spherical and spring biased to bear evenly on a respective slipper, thereby providing a seal under pressure.

The slipper includes a generally rectangular body having an inner arcuate side surface for engagement with a cam lobe on the crankshaft and an opening through the body to permit centrifugal flow of fluid for piston filling. The opposite side of the slipper body includes a recess for retaining a hardened annular seat insert. The spherical piston head rides on the inner circumference or edge at the top of the insert and is supported by the insert so that it will not engage the bottom of the slipper body recess.

The upper inner edge of the insert provides a sharp line of contact between the slipper and spherical piston head so that a wiping action occurs when there is relative motion between the piston and slipper. Further, an open area is provided on both sides of the line of contact between the piston and slipper to prevent contaminants from entering between the contacting surfaces which would spoil the seat.

The hardened seat insert also eliminates the potential for harmful contaminants being embedded in the surface of the seat which has occurred with existing slipper designs. Thus, the slipper of the present invention reduces the wear on the spherical piston head which has occurred when contaminants are embedded in the contacting surface between the piston and slipper.

Other advantages and meritorious features of the slipper of the present invention will be more fully understood from the following description of the preferred embodiment, the appended claims, and the drawings, a brief description of which follows.

DETAILED DESCRIPTION OF THE INVENTION

Figure 2:
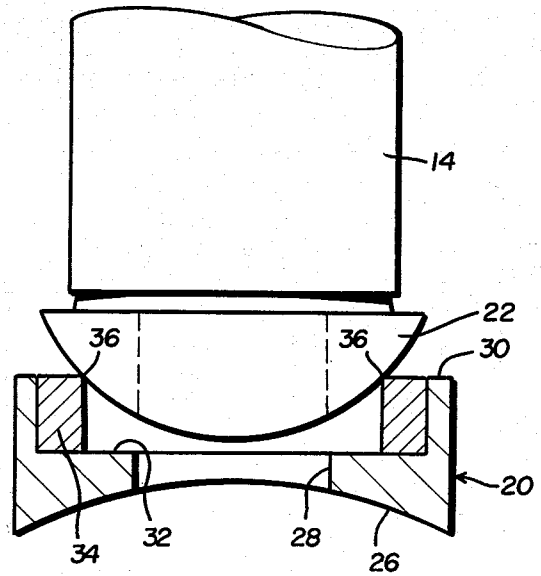
FIG. 2 is a cross sectional view taken along line 2—2 in FIG. 1 illustrating the slipper construction.
Figure 1:
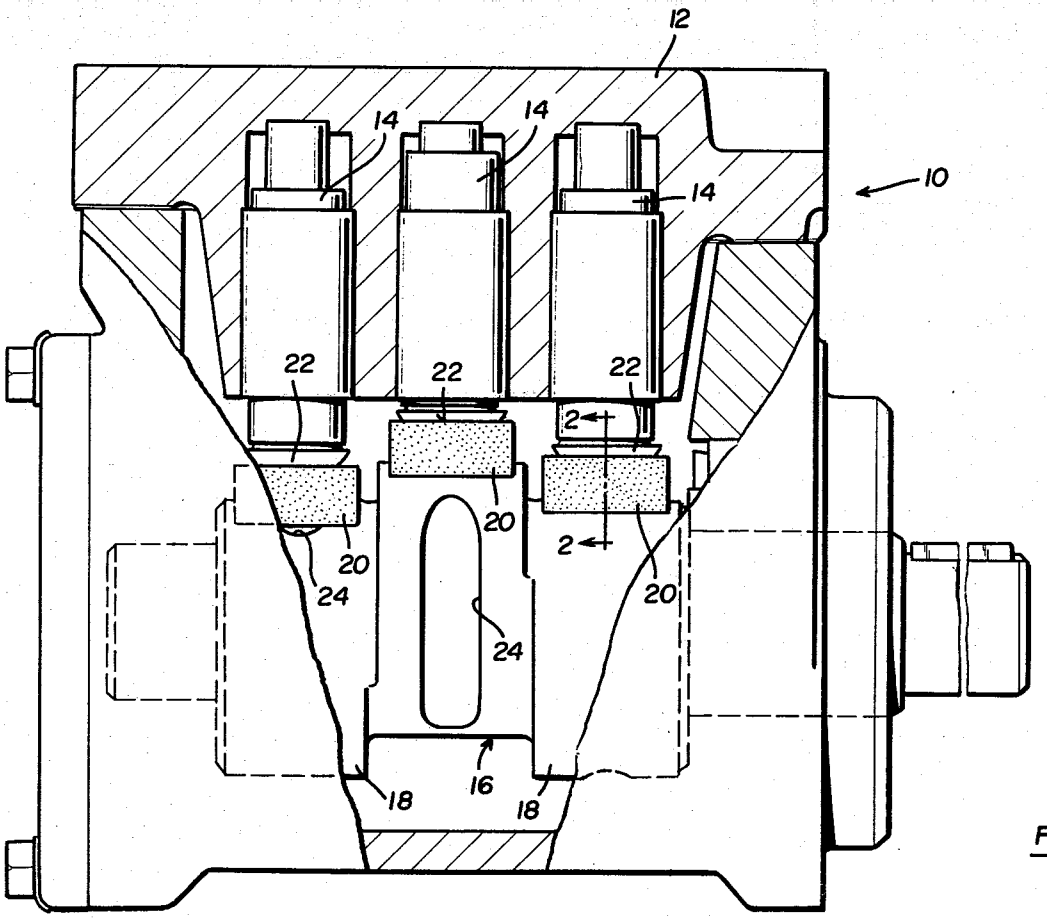
FIG. 1 is a side elevational view of a hydraulic pump incorporating the improved slipper of the present invention with a portion of the pump housing cut away for easier viewing.

A preferred embodiment of the improved slipper made in accordance with the teachings of the present invention is illustrated in FIGS. 1 and 2.

The hydraulic pump 10 illustrated in FIG. 1 is a "PS" series pump manufactured and sold by Poclain Hydraulics, and it includes a housing 12 with one or more lines of pistons 14 arranged around a crankshaft 16. Crankshaft 16 includes a number of cam lobes or crank pins 18, and each piston 14 is connected to a respective crank pin by a slipper 20 made in accordance with the teachings of the present invention.

Each piston 14 includes an enlarged spherical end or head 22 with an axial drilling therethrough which allows fluid flow in through the piston head for filling the piston with fluid. A return spring (not shown) holds each piston in position on a respective slipper 20 such that its piston head 22 is caused to bear evenly on the slipper to provide sealing under pressure.

The hydraulic fluid is fed into the body casing 12, and lights 24 situated on the circumference of the crank pins 18 promote the suction necessary for filling the pistons 14. The rotation of crankshaft 16 and design of lights 24 give a centrifugal flow to the fluid which causes filling of pistons 14. Further details of the construction of pump 10 are unnecessary since they form no part of the present invention.

The slipper 20 of the present invention is used in hydraulic pumps of the radial piston type of either fixed or variable displacement such as illustrated in FIG. 1. Slipper 20 includes a generally rectangular body have an inner arcuate side surface 26 for engagement with a crank pin 18 on crankshaft 16. An opening 28 is provided in slipper body 20 to permit centrifugal flow of fluid into piston 14 for piston filling. The opposed side 30 of slipper 20 includes a recess 32 for retaining a hardened annular seat insert 34.

The spherical piston head 22 rides on the inner circumference or edge 36 at the top of insert 34 and is supported by insert 34 so that its lower end will not engage the bottom of recess 32. The upper inner edge 36 of insert 34 provides a sharp line of contact between slipper 20 and spherical piston head 22 so that a wiping action occurs when there is relative motion between the piston head 22 and slipper 20. Further, an open area, as illustrated in FIG. 2, is provided on both sides of the line of contact 36 between slipper 20 and piston head 22 to prevent contaminants from entering between the contacting surfaces which would spoil the seat between piston 14 and slipper 20.

The hardened seat insert 34 also eliminates the potential for harmful contaminants from being embedded in the surface of the seat which has occurred with previous slipper designs using softer material. Thus, the slipper of the present invention prevents excessive wear on the spherical piston head 22 that occurs when contaminants are embedded in the contacting surface of the seat between the piston and slipper.

It will be apparent to those skilled in the art that the foregoing disclosure is exemplary in nature rather than limiting, the invention being limited only by the appended claims.

We claim:

1. A piston slipper for fluid pressure pumps of the radial piston type, said slipper including a generally rectangular body having inner and outer surfaces, said inner surface being arcuately shaped for engagement with a cam lobe on a crankshaft, said slipper body including an opening therethrough to permit centrifugal flow of fluid through said slipper, said outer surface including a recess retaining a hardened annular seat insert, said insert including an inner circumferential right angle corner which provides a sharp line of contact for engaging and supporting the spherical end of a piston, and said circumferential inner corner providing a wiping action on said spherical end of said piston and said spherical piston end extending into said seat insert and being movable relative thereto.

2. In a fluid pressure pump of the radial piston type, including a piston having an enlarged spherical head with an axial drilling therethrough which allows fluid flow in through the piston head and a crankshaft having at least one cam lobe, the improvement comprising:

a slipper including a body having inner and outer surfaces, said inner surface being arcuately shaped for engagement with said cam lobe on said crankshaft, said slipper including an opening therethrough to permit centrifugal flow of fluid through said slipper, said outer surface including a recess retaining a hardened annular seat insert, said insert including an inner circumferential right angle corner which provides a sharp line of contact for engaging and supporting said spherical piston head for articulate movement, said spherical piston head extending into said seat insert, said recess including a bottom wall and said circumferential corner of said insert supporting said piston head above said bottom wall thereby providing substantial open space on both sides of said line of contact between said piston head and slipper to prevent contaminants from entering between the contacting surfaces of said piston head and slipper and said circumferential corner providing a wiping action against said piston head as said piston head moves relative to said slipper.

* * * * *